US005480751A

United States Patent [19]

Williams et al.

[11] Patent Number: 5,480,751

[45] Date of Patent: Jan. 2, 1996

[54] TRI-LEVEL BACKGROUND SUPPRESSION SCHEME USING AN AC SCOROTRON WITH FRONT ERASE

[75] Inventors: James E. Williams, Rochester; Richard P. Germain, Webster, both of N.Y.

[73] Assignee: Xerox Corporation, Stamford, Conn.

[21] Appl. No.: 268,593

[22] Filed: Jun. 30, 1994

[51] Int. Cl.[6] ..... G03G 13/045

[52] U.S. Cl. ..... 430/42; 430/45; 430/902

[58] Field of Search ..... 430/42, 45, 902; 355/208

[56] References Cited

U.S. PATENT DOCUMENTS

| | | | |
|---|---|---|---|
| 3,444,369 | 5/1969 | Malinaric | 250/65 |
| 3,784,300 | 1/1974 | Hudson et al. | 355/3 |
| 4,078,929 | 3/1978 | Gundlach | 96/1.2 |
| 4,205,322 | 5/1980 | Tsuzuki et al. | 346/153 |
| 4,506,971 | 3/1985 | Buell et al. | 355/37 R |
| 4,879,194 | 11/1989 | Snelling | 430/53 |
| 5,038,177 | 8/1991 | Parker et al. | 355/273 |
| 5,339,135 | 8/1994 | Schever et al. | 355/208 |

*Primary Examiner*—John Goodrow

[57] ABSTRACT

Deposition of background toner particles during tri-level image transfer from an imaging member to a final substrate is minimized. A front erase step is used prior to pretransfer corona treatment in order to reduce the background voltage level to substantially the residual voltage level of the photoreceptor imaging member used in the imaging process. When the image is subjected to pretransfer corona positively charged black and color background toner particles become negative and wrong sign black toner becomes more negative. Using negative transfer corona effects transfer of toner forming the black and color images and inhibits transfer of background toner.

16 Claims, 3 Drawing Sheets

TRI-LEVEL BACKGROUND SUPPRESSION SCHEME USING AN AC SCOROTRON WITH FRONT ERASE

BACKGROUND OF THE INVENTION

This invention relates generally to tri-level imaging and more particularly to a method and apparatus for reducing the amount of background toner particles deposited on a final substrate during the transfer of a tri-level image from a charge retentive surface to a substrate such as plain paper.

In the practice of conventional xerography, it is the general procedure to form electrostatic latent images on a xerographic surface by first uniformly charging a charge retentive surface such as a photoreceptor. Only the imaging area of the photoreceptor is uniformly charged. The image area does not extend across the entire width of the photoreceptor. Accordingly, the edges of the photoreceptor are not charged. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past a single developer housing. The toner is generally a colored powder which adheres to the charge pattern by electrostatic attraction. The developed image is then fixed to the imaging surface or is transferred to a receiving substrate such as plain paper to which it is fixed by suitable fusing techniques.

In tri-level, highlight color imaging, unlike conventional xerography, the image area contains three voltage levels which correspond to two image areas and to a background voltage area. One of the image areas corresponds to non-discharged (i.e. charged) areas of the photoreceptor while the other image areas correspond to discharged areas of the photoreceptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

In highlight color xerography as taught by Gundlach, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged-area development, i.e. CAD) stays at the full photoreceptor potential ($V_{cad}$ or $V_{ddp}$, shown in FIG. 1*a*). The other image is exposed to discharge the photoreceptor to its residual potential, i.e. $V_{dad}$ or $V_c$ (typically 100 v) which corresponds to discharged area images that are subsequently developed by discharged-area development (DAD) and the background areas exposed such as to reduce the photoreceptor potential to halfway between the $V_{cad}$ and $V_{dad}$ potentials, (typically 500 v) and is referred to as $V_{white}$ or $V_w$. The CAD developer is typically biased about 100 v ($V_{bb}$, shown in FIG. 1*b*) closer to $V_{cad}$ than $V_{white}$ (about 600 v), and the DAD developer system is biased about 100 v ($V_{cb}$, shown in FIG. 1*b*) closer to $V_{dad}$ than $V_{white}$ (about 400 v).

After development of the tri-level image is complete, a pre-transfer step must be performed in order to make all of the toner on the photoreceptor (both colors) common in polarity so that conventional transfer methods can be utilized. For sake of illustration, it is assumed that a pre-transfer device is operating in the positive mode, and that transfer is operating negatively. When the developed tri-level image is exposed to a positive pre-transfer dicorotron, the negative charge on the color toner changes to positive, making it common in sign with the black toner. This enables transfer of the developed image to paper using negative corona. However, because the low charged and/or wrong sign toner present in the background areas is also exposed to the pre-transfer dicorotron, it also becomes positive (or more positive in the case of the wrong-sign color background). As a result, the background toner also tends to transfer to paper, which results in visible background on the fused tri-level prints.

It is well known in the prior art to subject a developed image on a charge retentive surface to corona discharge prior to image transfer for various reasons. For, example, U.S. Pat. No. 3,444,369 issued on May 13, 1969 relates to a method and apparatus for the reduction of background in transferred xerographic copy. A developed toner image on a photoconductive surface is subjected to a low level corona discharge of a polarity opposite the charge on the toner particles overlying the image areas. The corona discharge adjacent the image areas will be repelled by the like sign, but highly charged image areas of the photoconductive surface to thereby render the image area toner unaffected. The corona discharge adjacent the non-image areas of the photoconductive surface will not be repelled and will thus convert the toner overlying the non-image areas to a polarity opposite that on the image area toner particles. This will permit the electrostatic transfer of the image area toner, but will tend to suppress the transfer of the non-image area toner to a backing sheet.

It is also known to utilize light exposure and corona discharge prior to image transfer as shown in U.S. Pat. No. 4,506,971. In this device the light exposure occurs prior to the corona exposure. As stated therein, blurred images are minimized or eliminated in a xerographic reproduction prior to transfer by first exposing the image to light to at least substantially discharge the background around the image and to reduce the charge on the photoreceptor holding the image thereto. Secondly, a charge of opposite polarity of the charged photoreceptor is deposited onto the image and photoreceptor. This, as stated, produces a very stable image for transfer since a very strong holding force is produced to hold the image in place as the image enters the transfer station.

U.S. Pat. No. 3,784,300 issued on Jan. 8, 1974 relates to a copying apparatus with a pre-transfer station including a pre-transfer corotron and lamp arranged such that the light exposure of the photoreceptor is subsequent and not simultaneous with the pre-transfer corona charging.

U.S. Pat. No. 4,205,322 issued on May 27, 1980 relates to an electrostatic recording apparatus in which a toner image consisting of toner particles of at least two different kinds and of different polarities is efficiently and reliably transferred to a recording medium such as an ordinary sheet of paper. The toner particles having different polarities are all converted into those having one polarity and after such conversion the toner image (with its two kinds of particles) is electrostatically transferred to the recording medium, the transfer involving both kinds of particles at the same time.

U.S. Pat. No. 5,038,177 granted to Parker et al on Aug. 6, 1991 describes that balanced, efficient corona transfer for both the charged area image and the discharged area image of a developed tri-level image is obtained by the provision of a selective pretransfer charge corona device in combination with a pretransfer discharge lamp. While improved transfer over prior art devices is obtained using a pretransfer lamp prior to pretransfer charging the preferred embodiment of the invention utilizes a pretransfer lamp before and in coincidence with pretransfer charging. In this patent the pretransfer lamp is positioned adjacent the side of the photoreceptor opposite the toner images for controlling the magnitude and distribution of pre-transfer current so that disproportionately more charge is added to the part of composite tri-level image that must have its polarity reversed compared to elsewhere on the image.

U.S. patent application Ser. No. 08/179,176 filed in the name of Pietrowski et al on Jan. 10, 1994 discloses pre pretransfer treatment for multiple toner images for increasing the operating latitude for pretransfer/transfer. In one embodiment of the invention, a pre pretransfer corona device is used to drive the tribos of two multiple toner images toward each other prior to pretransfer. A single constant current corona discharge device is used in that embodiment. Subsequent pretransfer treatment serves to reduce the delta tribo between the two images thereby providing an operating latitude of 3 micro coul/g.

BRIEF SUMMARY OF THE INVENTION

Briefly, the present invention reduces the amount of background toner transfer from a tri-level imaging surface or photoreceptor to a final substrate such as plain paper. To this end, an imaging surface containing a tri-level image is exposed to a well collimated light. The surface containing the image is exposed to the collimated light to thereby reduce the background voltage part of the tri-level image to approximately the residual voltage level of the photoreceptor imaging surface. Subsequent to light exposure of the tri-level image, the image is subjected to a substantially constant voltage scorotron which causes the polarity of one of the images to become the same as the other image. The charge on the background particles becomes negative or more negative in the case of wrong sign black toner.

DETAILED DESCRIPTION OF THE PREFERRED EMBODIMENT OF THE INVENTION

Figure 3:
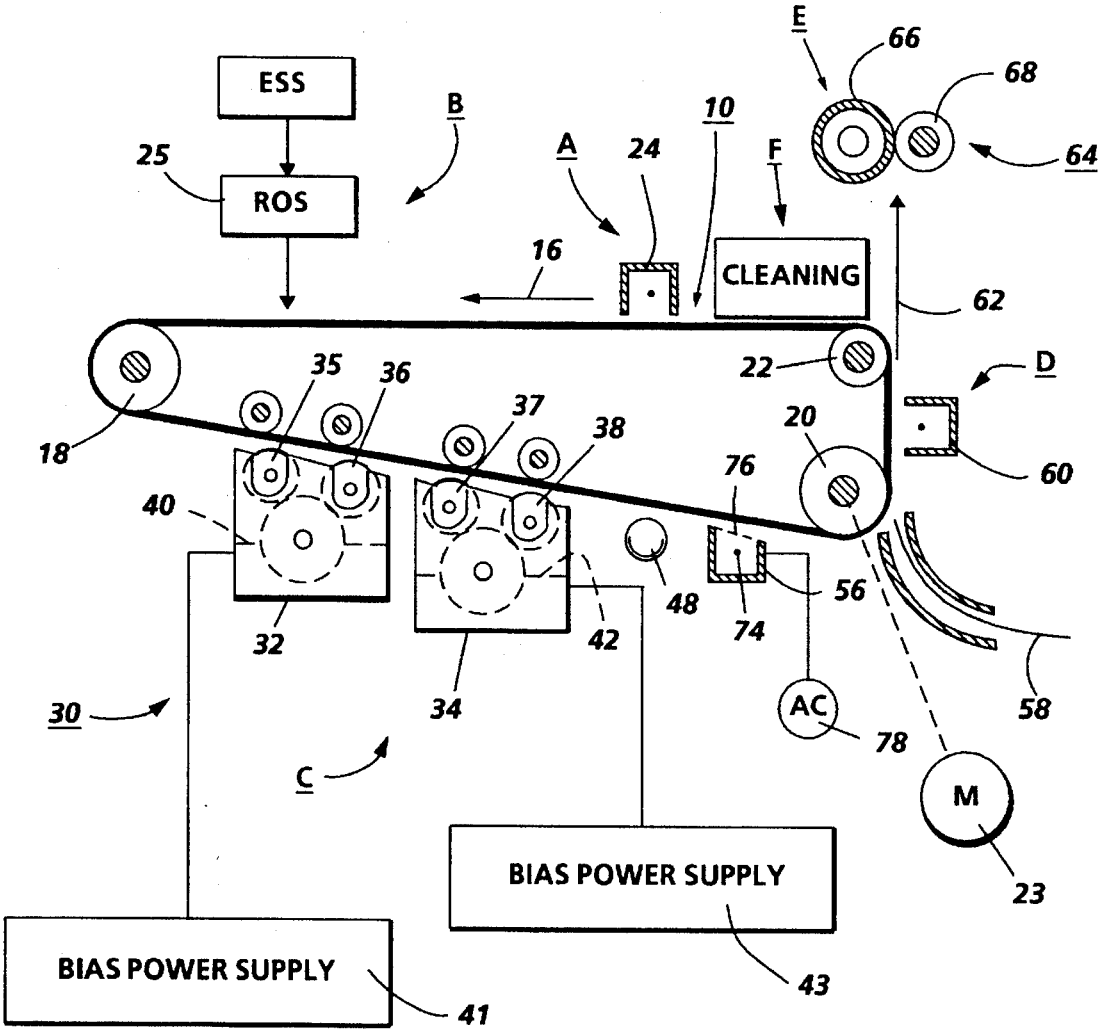
FIG. 3 is schematic illustration of a printing apparatus incorporating features of the invention.

As shown in FIG. 3, a printing machine incorporating the invention may utilize a charge retentive member in the form of a photoconductive belt 10 consisting of a photoconductive surface and an electrically conductive, light transmissive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22. Roller 20 is used as a drive roller while the rollers 18 and 22 serve to tension the belt 10 and effect substrate stripping from the belt 10, respectively. A motor 23 rotates roller 20 to advance belt 10 in the direction of arrow 16. Roller 20 is coupled to motor by suitable means such as a belt drive.

As can be seen by further reference to FIG. 3, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_0$. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as background areas intermediate the charged and discharged areas.

Figure 1A:
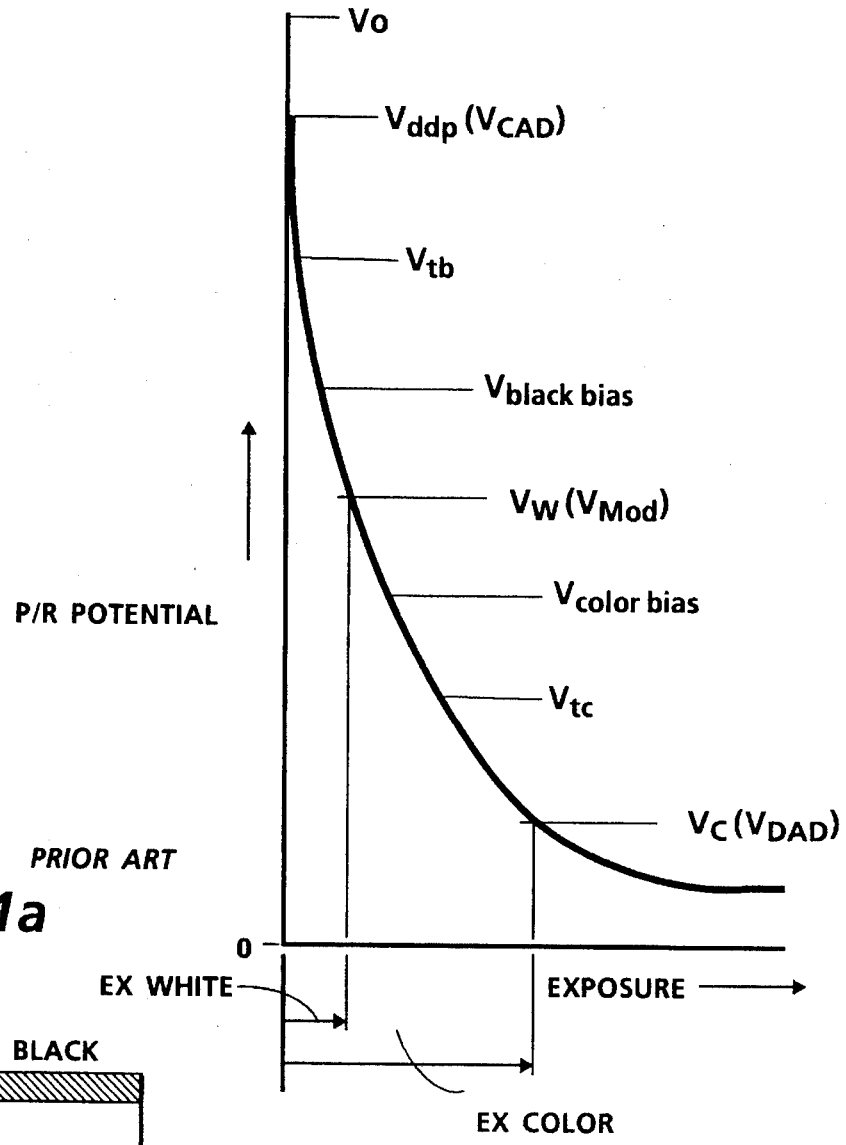
PRIOR ART FIG. 1a
FIG. 1*a* is a plot of photoreceptor potential versus exposure illustrating a tri-level electrostatic latent image.
Figure 1B:
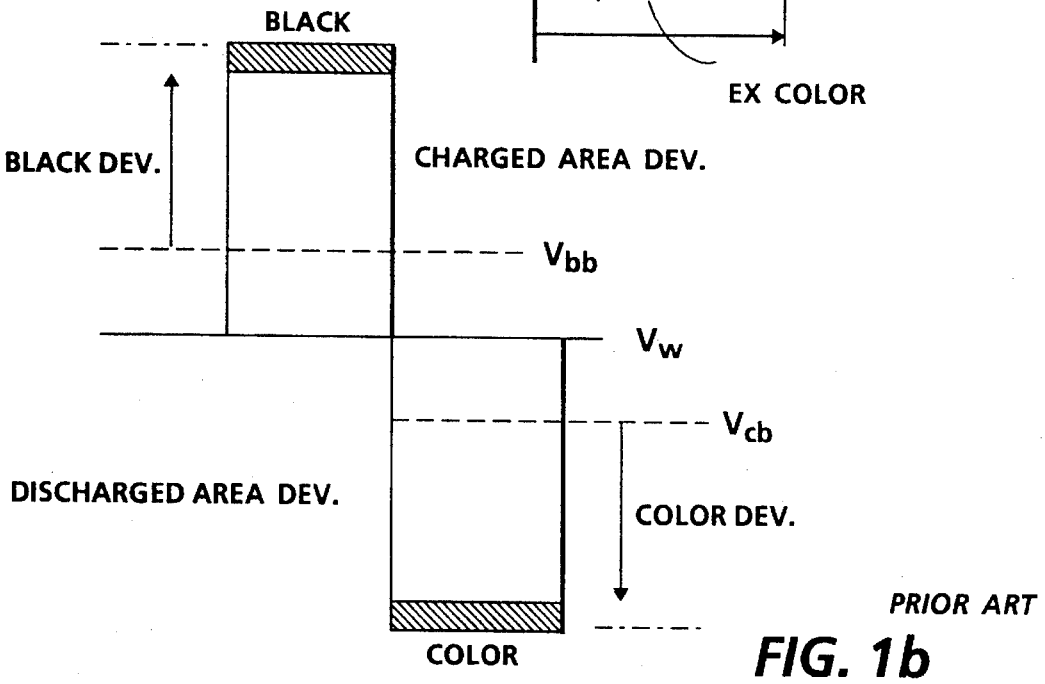
PRIOR ART FIG. 1b
FIG. 1*b* is a plot of photoreceptor potential illustrating single-pass, highlight color latent image characteristics.

The photoreceptor, which is initially charged to a voltage $V_0$, undergoes dark decay to a level $V_{ddp}$ equal to about 900 volts. When exposed at the exposure station B it is discharged to $V_{Color}$ (DAD) equal to about −300 volts in the highlight (i.e. color other than black) color parts of the image. See FIG. 1*a*. The photoreceptor is also discharged to $V_w$ equal to −400 volts imagewise in the background (white) image areas. The photoreceptor is discharged to $V_{Black(CAD)}$ equal to −500 volts. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged red toner. Electrical biasing is accomplished via power supply 41 electrically connected to developer apparatus 32. A DC bias of approximately −350 volts is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A suitable DC bias of approximately −450 volts is applied to the rollers 37 and 38 via the bias power supply 43.

Because the composite image developed on the photoreceptor consists of both positive and negative toner, a front erase lamp 48 and a positive pre-transfer corona discharge member 56 are provided to condition the toner for effective transfer to a substrate with minimal transfer of background toner particles. Negative corona discharge is utilized.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls, not shown, rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A magnetic brush cleaner housing is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charging thereof for the successive imaging cycle.

Figure 2A:
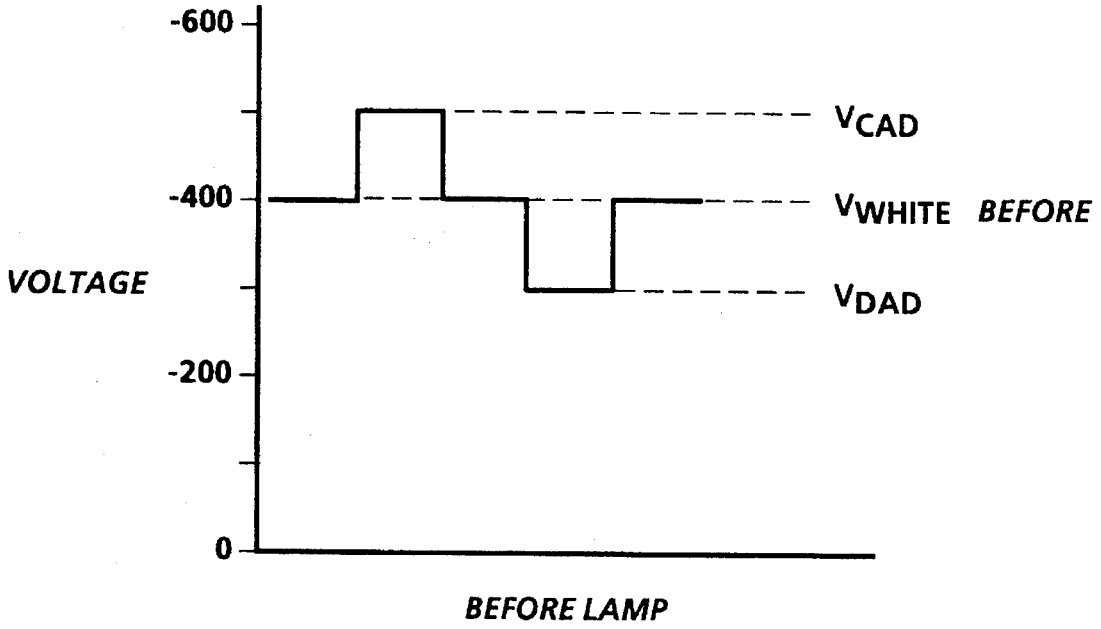
FIGS. 2*a* and 2*b* depict a fully developed tri-level image before and after front erase treatment.
Figure 2B:
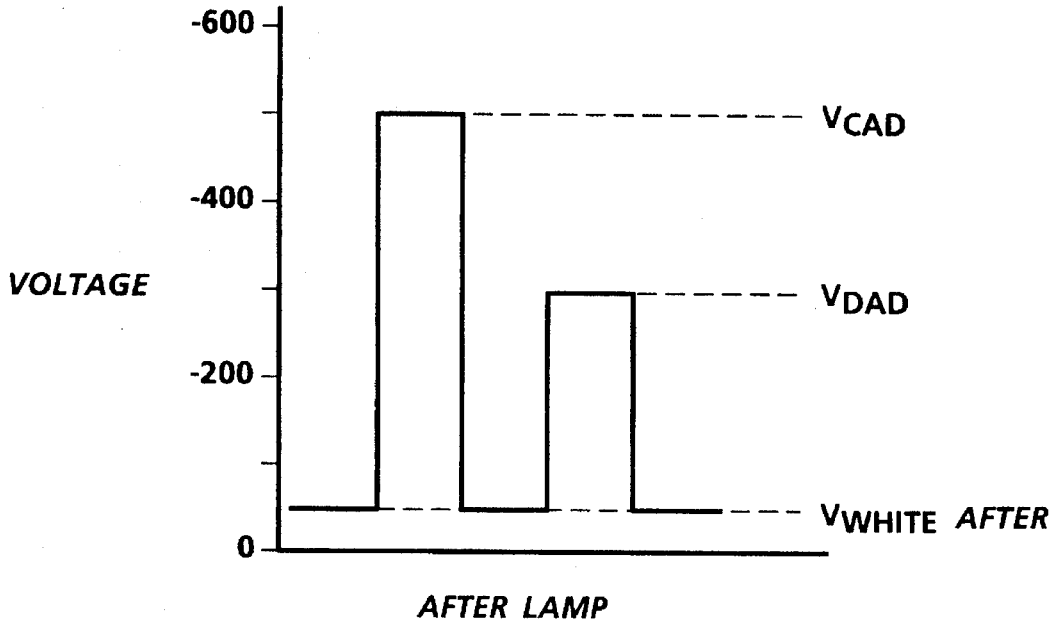

After development of the tri-level latent image is complete, typical post-development voltages on the photoreceptor in the Charged Area, ($V_{CAD}$), Discharged Area, ($V_{DAD}$), and white areas ($V_{WHITE}$) are as follows:

$V_{CAD}$ (Post-DEV)=−500 V $V_{DAD}$ (Post-DEV)=−300 V $V_{WHITE}$ (Post-DEV)=−400 V In accordance with the invention, when the developed, two-color image is exposed to the front erase pre-transfer discharge lamp 48, the following occurs. Because very little toner exists in the background areas ($V_{WHITE}$), the pre-transfer light discharges these background areas to approximately the residual potential of the photoreceptor, which for a commercially available active matrix photoreceptor, is typically about −50 volts. The light from the lamp does not have a large effect on the post development voltages in either the CAD black or DAD color areas, because these areas are developed with toner which should block light from getting to the photoreceptor. In order to minimize the possibility that light might pass through the more translucent color toner (red, blue, or green), pre-transfer light that has a wavelength (λ) that would be absorbed by the color toner (i.e. use blue light for red toner) may be employed. The light from the front erase pre-transfer lamp 48 is preferably a well collimated light to avoid discharging the photoreceptor near the edges of the developed black and color image areas, which may be especially critical for fine lines and halftone patterns. FIG. 2 depicts he fully developed Tri-level image voltage profile both before and after exposure to the front erase pre-transfer lamp 48.

After exposure to the front erase pre-transfer lamp 48, the developed tri-level image is exposed to the AC scorotron 56 of the type disclosed in U.S. Pat. No. 4,591,713 granted to gundlach et al on May 27, 1986. The scorotron 56 comprises an insulative housing 72, a plurality of coronode wires 74 and a control screen or grid 76. The control grid 76 is biased with a steady state DC bias that is somewhat negative, in the order of −100 V to −150 V, given the electrostatics shown in FIGS. 2*a* and 2. The coronode wires 74 of the scorotron have a high voltage AC potential (sine-wave) source 78 applied to them that is sufficient in amplitude to generate both positive and negative charges during ionization. The frequency of the applied AC is high enough, in the order of 1–5 Khz, so as not to cause visible strobing on the prints. Because the post-development $V_{CAD}$ and $V_{DAD}$ (−500 V and −300 V, respectively), are both more negative than the scorotron control grid the positive charges from the scorotron flow to these image areas until their surface potential approaches the scorotron grid voltage. This flow of positive charge changes the negatively charged color toner to positive charge, without greatly increasing the positive charge already present on the black toner. Because the $V_{WHITE}$ regions of the photoreceptor are more positive than the scorotron control grid due to the front erase treatment using the lamp 48, the negative charges from the scorotron flow to the toner located in these areas until the surface potential approaches that of the control grid. As a result, the charge on the black and color toner comprising background become negative (or more negative in the case of wrong sign black), which significantly reduces the likelihood that background toner particles on the imaging surface will transfer to paper when using negative transfer current of the device 60. While an AC scorotron has been disclosed it will be appreciated that a DC device may also be utilized.

What is claimed is:

1. A method of creating highlight color images, said method including the steps of:

uniformly charging an imaging member capable of retaining electrostatic charges;

selectively discharging said uniformly charge imaging member to form two image areas and a background area, said background area being disposed intermediate said two image areas;

developing said two image areas using black and color toners having opposite charge polarities to form two visible images at first and second charge levels without disturbing said background level;

shifting the charge level of said background area from said position intermediate said two image areas such that it is at a greater or lesser charge level than both of said two image charge levels; and subsequent to said step of shifting, exposing said imaging member to corona discharge for changing the polarity of one of said two images to the same polarity as the other of said two images.

2. The method according to claim 1 wherein said step of shifting comprises using an erase device.

3. The method according to claim 2 wherein said erase device comprises a well collimated light source.

4. The method according to claim 3 wherein said step of using a well collimated light source comprises directing said light source at the image side of said imaging member.

5. The method according 4 wherein said step of exposing said imaging member to corona discharge comprises using a scorotron.

6. The method according to claim 5 wherein said step of using a scorotron comprises using a substantially constant voltage device.

7. The method according to claim 3 wherein said collimated light source is operated at a wavelength such that it is absorbed by said color toner.

8. Apparatus for creating highlight color images, said apparatus comprising:

means for uniformly charging an imaging member capable of retaining electrostatic charges;

means for selectively discharging said uniformly charge imaging member to form two image areas and a background area, said background area being disposed intermediate said two image areas;

means for developing said two image areas using black and color toners having opposite charge polarities to form two visible images at first and second charge levels without disturbing said background level;

means for shifting the charge level of said background area from said position intermediate said two image areas such that it is at a greater or lesser charge level than both of said two image charge levels; and means for exposing said imaging member to corona discharge for changing the polarity of one of said two images to the same polarity as the other of said two images.

9. Apparatus according to claim 8 wherein said means for shifting comprises an erase device.

10. Apparatus according to claim 9 wherein said erase device comprises a well collimated light source.

11. Apparatus according to claim 10 wherein said well collimated light source is disposed opposite the image side of said imaging member.

12. Apparatus according 11 wherein said means for exposing said imaging member to corona discharge comprises a scorotron.

13. Apparatus according to claim 12 wherein said scorotron comprises a substantially constant voltage device.

14. The method according to claim 6 wherein said scorotron comprises an AC device.

15. Apparatus according to claim 13 wherein said scorotron comprises an AC device.

16. Apparatus according to claim 10 including means for operating said collimated light source at a wavelength such that it is absorbed by said color toner.

* * * * *